United States Patent [19]

Bayless

[11] 4,264,839

[45] Apr. 28, 1981

[54] ORIENTATION INDEPENDENT IGNITRON

[75] Inventor: John R. Bayless, Malibu, Calif.

[73] Assignee: Hughes Aircraft Company, Culver City, Calif.

[21] Appl. No.: 47,672

[22] Filed: Jun. 12, 1979

[51] Int. Cl.[3] ..... H01J 7/24; H01J 13/06; H01J 13/32

[52] U.S. Cl. ..... 313/29; 313/34; 313/171

[58] Field of Search ..... 313/171, 170, 32, 34, 313/29

[56] References Cited

U.S. PATENT DOCUMENTS

| | | | |
|---|---|---|---|
| 2,740,911 | 4/1956 | Doolittle | 313/34 |
| 2,821,511 | 1/1958 | Lewin | 313/171 X |
| 3,119,943 | 1/1964 | Holliday et al. | 313/170 X |
| 3,659,132 | 4/1972 | Eckhardt | 313/32 |
| 4,060,748 | 11/1977 | Bayless | 313/171 |

*Primary Examiner*—Palmer C. Demeo

*Attorney, Agent, or Firm*—Allen A. Dicke, Jr.; W. H. MacAllister

[57] ABSTRACT

Orientation independent ignitron 10 has a cooled cathode 28 which carries thin mercury film 58 which is held in place by surface tension forces so that it is independent of orientation. Ignitor 48 starts conduction which continues until mercury exhaustion or shut off by an external circuit. During nonconductive portions of the duty cycle, the mercury recondenses on the cooled cathode 30.

8 Claims, 3 Drawing Figures

ORIENTATION INDEPENDENT IGNITRON

The ignitron has a cooled cathode with a film of mercury condensed thereon and held in place by surface tension forces so that it is independent of orientation. An ignitor starts conduction. The ignitron is a small, lightweight closing switch suitable for high power, low duty cycle operation.

There is a need for the capability of turning on high power electrical devices. The prior art includes the conventional ignitron which has a mercury pool and thus orientation and immobility are important. Prior art also includes the liquid metal plasma valve, patented by W. O. Eckhardt, U.S. Pat. No. 3,659,132, which has a long turn-on time due to its low operating pressure. This device also requires a mercury feed system. There is no simple, portable, non-complex, lightweight, closing switch which is suitable for a high-power, low-duty cycle operation.

SUMMARY

In order to aid in the understanding of this invention it can be stated in essentially summary form that it is directed to an orientation independent ignitron wherein a cooled solid cathode carries a mercury film. The film is held in place by surface tension forces and is of sufficient volume for a burst of pulses. After and after the pulse burst, the mercury recondenses on the cathode so that it is available for another pulse burst.

It is thus an object of this invention to provide an ignitron which is of small, lightweight construction and is suitable for high-power, low duty cycle operation. It is another object to provide an ignitron which is constructed so that it can operate in any orientation, or in a portable application. It is another object to provide an orientation independent ignitron which has a closed envelope and does not require a feed system for its operation. It is a further object to provide an orientation independent ignitron suitable for turning on against high voltages (greater than 38 kilovolts) and carry high peak currents (greater than 12 kiloamperes) without excessive internal heating.

Other objects and advantages of this invention will become apparent from a study of the following portion of this specification, the claims and the attached drawings.

DESCRIPTION

Figure 1:
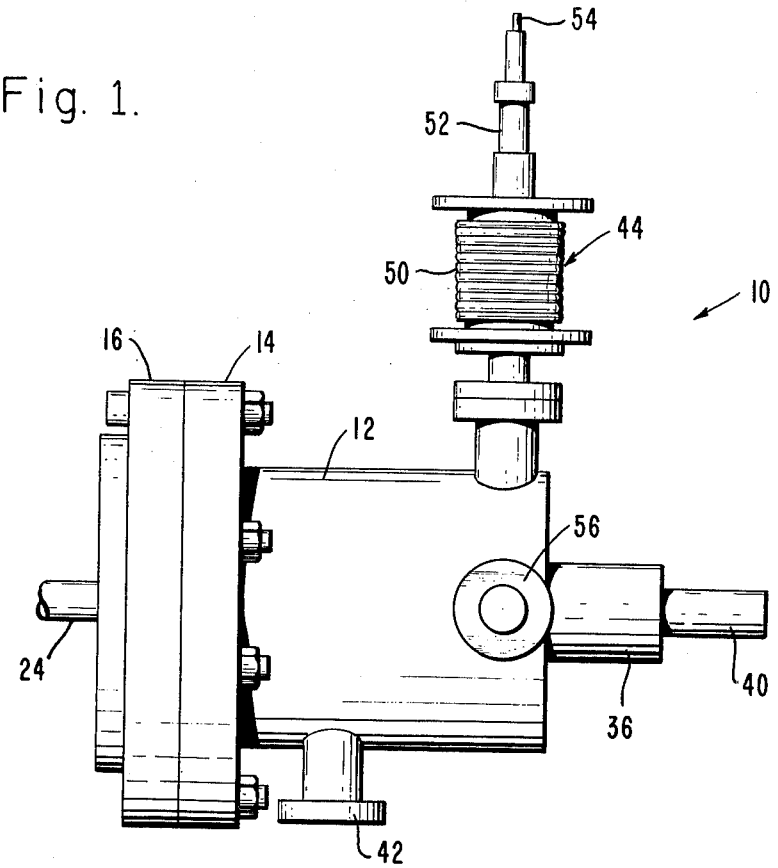
FIG. 1 is a side elevational view of an orientation independent ignitron in accordance with this invention.
Figure 3:
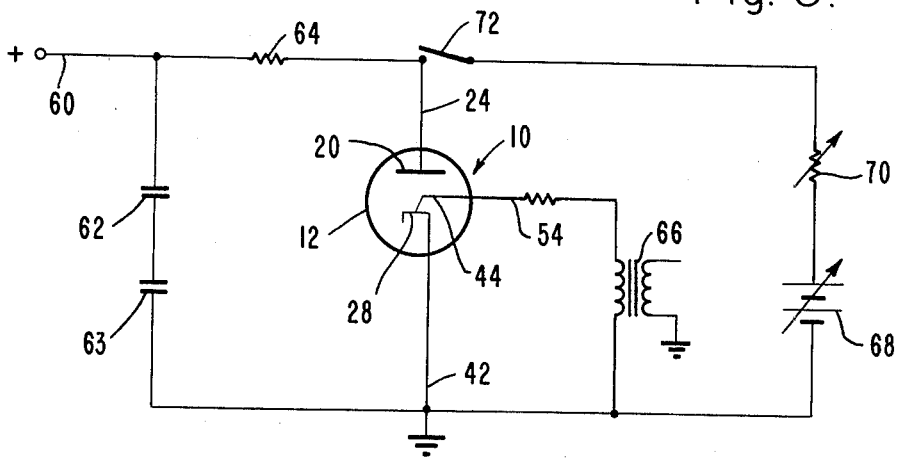
FIG. 3 is an electrical schematic diagram of a test circuit showing one manner of testing the orientation independent ignitron.
Figure 2:
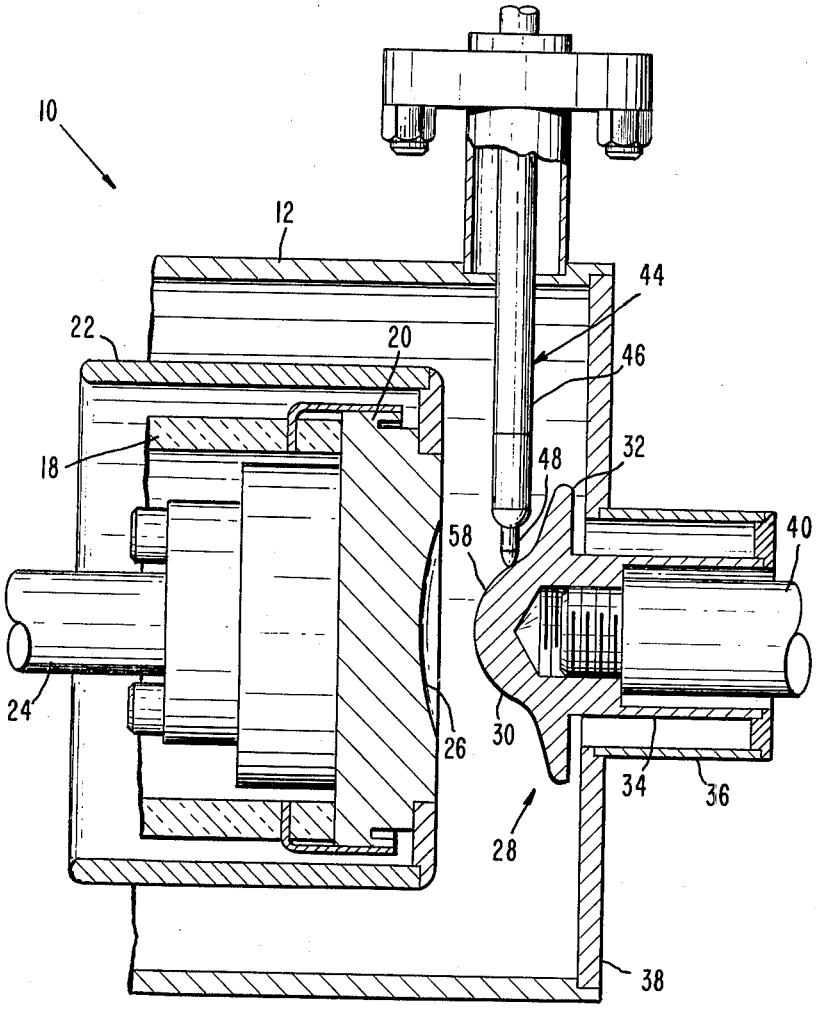
FIG. 2 is an enlarged center line section of the ignitron of FIG. 1 taken in the plane of the paper of FIG. 1, with parts broken away.

The orientation independent ignitron of this invention is generally indicated at 10 in FIGS. 1, 2 and 3. It comprises housing 12 which carries flange 14 for access to the interior. Flange 16 is mounted against flange 14 and carries anode insulator 18, see FIG. 2. Anode 20 is mounted on anode insulator 18 and is positioned within housing 12. Anode insulator shield 22 is mounted on anode 20 and extends toward flange 16 around insulator 18 to protect the insulator against deposition of sputtered materials. Anode lead 24 is connected to anode 20 for connection into the circuit. Anode 20 is made of metal, preferably one of the refractory metals such as molybdenum, and has a concave face 26 which faces cathode 28.

Cathode 28 is dome-shaped with cap 30 surrounded by skirt 32. The cap 30 faces concave face 26 of the anode. Cathode 28 is carried on inner tube 34 which extends outwardly toward the right from the main part of the housing 12. It joins outer tube 36 which extends to the left and is mounted on right wall 38 of the housing. The purpose of these thinwall tubes is to substantially thermally isolate the dome of cathode 28 from the remainder of the system. Cathode 28 is preferably also made of refractory metal, such as molybdenum. In order to limit the temperature rise of cathode 28 and to aid in its cooling, heat sink 40 is screwed into cathode 28 directly under cap 30. Heat sink 40 is preferably of a material of high thermal conductivity and high specific heat, such as copper. Furthermore, heat sink 40 can be externally cooled, as by radiator fins for air cooling or by other fluid cooling, if desired for a higher cycle rate.

Cathode 28 is electrically connected to housing 12, which serves as the cathode electrical connection to a circuit. Other types of connections to the housing 12 could alternatively be used.

Ignitor 44 has an ignitor rod 46 on which ignitor tip 48 is carried. Ignitor tip 48 is preferably of boron carbide or other arc resistant semiconducting material. It lies in contact with the side of the cap 30 of cathode 28. Ignitor rod 46 extends out through bellows 50, through insulator feedthrough 52 to ignitor connection 54. Ignitor connection 54 is both electrical and mechanical so that ignitor tip 48 can be electrically connected to a source of ignition current and the ignitor tip pressure on the cathode 28 may be adjusted to cause an ignition arc. Bellows 50 provides for vacuum closure between the adjustable ignitor and the cathode 28. In this way, housing 12 provides a vacuum enclosure for the inner electrode space so that an appropriate vacuum can be mainframed. Observation port 56 provides for visual observation to the inner electrode space, and is not necessary in ignitrons where observation is not required. Support foot 42 may be a vacuum pump connection for initial pumpdown. With proper closure of housing 12, continued pumpdown is not required, but the housing can be permanently closed.

Mercury film 58 covers the cap of cathode 28. Mercury film 58 is held in place by surface tension forces, thus making the ignitron 10 independent of orientation, and making it insensitive to vibration. The mercury volume of film 58 is sufficient for one conduction burst.

The purpose of the ignitron is to turn on in the presence of an applied high voltage and to conduct a large current after turn on. When a high voltage is applied, turn on is accomplished by pulsing a current through ignitor tip 48. This causes a discharge between the cathode surface and ignitor tip 48 to vaporize and ionize a portion of the mercury film on cathode 28. This plasma material permits initiation of conduction between cathode 28 and anode 20 for the beginning of conduction. Experiments have shown that the ignitron 10 turned on against applied voltages up to 38 kilovolts, with peak current conducted up to 12 kiloamperes. The current rate of rise was 7 kiloamperes per microsecond with ignition energy of about 0.6 joules. Current is conducted until it is turned off by a device in the external circuit.

After the conduction period, the film on the cathode 28 is replenished by condensation of vapor from the space within housing 12. Anode 20 is cooled by natural conduction and convection to the external environment during the off periods. The vacuum envelope and anode will operate at room temperature while the cathode 30 is slightly cooled, preferably by air blast on heat sink 40, in order to facilitate mercury condensation. Interelectrode spacings and spacings between other metal parts at anode and cathode potential are maintained at about 1 centimeter to avoid paschen breakdown.

The ignitron 10 can operate at a high frequency for a short time, as long as the mercury film is sufficient for pulsing. For example, with a peak current of 15 kiloamperes and a pulse width of 10 microseconds, a pulse repetition frequency of 50 pulses per second is possible. Recovery time between the pulses is 200 microseconds and the peak operating forward holdoff voltage after recovery is 30 kilovolts. The operating duty cycle under such operating conditions is 25 seconds on, with 10 minutes off. The entire 25 seconds of on time is accomplished with the film 58 without a replenishment. The ignitron 10 cools off during the 10 minutes off time and at that time the film 58 recondenses sufficiently so that the ignitron 10 is ready for another series of pulses.

The test circuit of FIG. 3 includes a high voltage DC source 60 which charges capacitors 62 and 63 to the desired test value. The capacitors are serially connected through ignitron 10 and current is limited by resistor 64. The ignitor 44 is pulsed by trigger transformer 66 so that the ignitron 10 conducts until the capacitors are discharged. If offswitching is desired, the interrelated capacitive, resistance and inductive characteristics of the circuit are adjusted so that ringing takes place to achieve a natural current zero. In this way, the continuing pulse series can be tested. When a test for substantiated current is required, variable voltage sustained current source 68 can be turned on through variable resistor 70 by switch 72.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

I claim:

1. A mobile orientation independent ignitron for use in vibration and shaking environments comprising:

a solid refractory metal cathode for carrying a layer of liquid metal thereon so that the liquid metal is retained on said cathode by surface tension in any orientation in a shaking environment;

thermal means connected to said cathode for cooling said cathode sufficiently so that liquid metal vapor condenses from said interelectrode space onto said cathode between ignitron operating periods to provide the layer of liquid metal on said cathode;

an anode facing said cathode and an interelectrode space therebetween;

means on both said anode and cathode for applying a potential therebetween;

an ignitor adjacent said cathode for providing an ignition discharge for generating plasma from the liquid metal on the surface of said cathode so that conduction occurs between said cathode and said anode; and a liquid metal pool-free housing enclosing the interelectrode space between said anode and said cathode so that low pressure can be maintained therebetween.

2. The ignitron of claim 1 wherein a thermal mass is connected to said cathode so that said cathode can retain a portion of its condensed liquid metal through a series of conductive pulses.

3. The ignitron of claim 2 wherein said cathode is connected to said housing through connection means of reduced thermal conductivity for limiting heat transfer from said housing to said cathode.

4. The ignitron of claim 3 wherein said cathode has a convexly domed surface and the ignitor has an ignitor tip positioned in contact with said cathode.

5. An orientation independent ignitron for use in shaking and vibration environments comprising:

a closed vacuum housing;

an anode within said housing;

a cathode within said housing, said cathode having a solid refractory surface spaced from said anode;

a liquid metal within said housing, said cathode being cool so that said liquid metal condenses on said cathode surface in a surface tension retained liquid metal film on said surface, said liquid metal being present within said housing only as a vapor and as a surface tension retained film, and a liquid metal pool being absent;

an ignitor adjacent said cathode surface so that when a potential is applied between said cathode and said anode and said ignitor produces an ignition discharge, plasma is produced from said liquid metal film on said cathode surface to permit conduction.

6. The orientation independent ignitron of claim 5 wherein said cathode is positioned away from the bottom of said housing.

7. The method of on-switching a circuit which has an orientation independent ignitron for use in a shaking and vibration environment and having an anode and a cathode connected into the circuit, with a surface tension retained liquid metal film on the cathode and without a liquid metal pool and with an ignitor comprising the steps of:

applying a potential between the anode and cathode;

permitting the ignitron to conduct for at least a short pulse by causing ignition thereof; and after the at least one pulse cooling the cathode so that evaporated liquid metal recondenses on the cathode in a film again retained by surface tension so that liquid metal is present only in vapor and film form so that another at least one pulse can be performed.

8. The method of claim 7 wherein the condensing step is accomplished by maintaining the cathode at a cooler temperature than the anode during the condensation.

* * * * *